United States Patent [19]

Jabs et al.

[11] 3,931,750

[45] Jan. 13, 1976

[54] HELICAL SHEAR BLADE

[75] Inventors: Hartmut Jabs, Verlautenheide, Germany; Minny Wiemers, 05, Dusseldorf-Gerresheim, all of Germany

[73] Assignees: Severin Heusch; Ida Plankermann; Anneliese Gattersleben; Hermann Gattersleben, all of Aachen; Finny Thoennissen, Rott, Aachen

[22] Filed: Jan. 24, 1975

[21] Appl. No.: 543,869

[30] Foreign Application Priority Data

Feb. 1, 1974 Germany ..... 2404837

[52] U.S. Cl. ..... 83/672; 83/349; 83/342; 26/15 R

[51] Int. Cl.[2] ..... D06C 13/00

[58] Field of Search ..... 83/342, 672, 349; 26/15 R, 26/15 L, 15 FB

[56] References Cited

FOREIGN PATENTS OR APPLICATIONS 12,589 1914 United Kingdom ..... 26/15

*Primary Examiner*—J. M. Meister

*Attorney, Agent, or Firm*—Herbert L. Lerner

[57] ABSTRACT

Helical shear blade cutter cooperable with a straight-edge bed plate for trimming fibers projecting from an article, including a shaft, and a blade in the form of a helical band wound edgewise on and about the shaft, the helical blade having a free edge forming a cutting edge from which a cutting face of the blade extends inwardly toward the shaft, the cutting face being formed with a serration to limit lateral yielding of the fibers as the fibers are being sheared by the cutting edge and the straight edge of the bed plate, the serration including saw-like teeth, respectively, having a short and a long flank, the long flank, in a condition wherein the shaft is disposed parallel to the straight-edge bed plate, forming a first angle with respect to the straight edge of the bed plate that is equal to the difference between a second angle formed by the cutting face of a blade without serrations formed therein and the straight edge of the bed plate and a third angle formed by the long flank and the cutting face of the blade without serrations formed therein.

5 Claims, 11 Drawing Figures

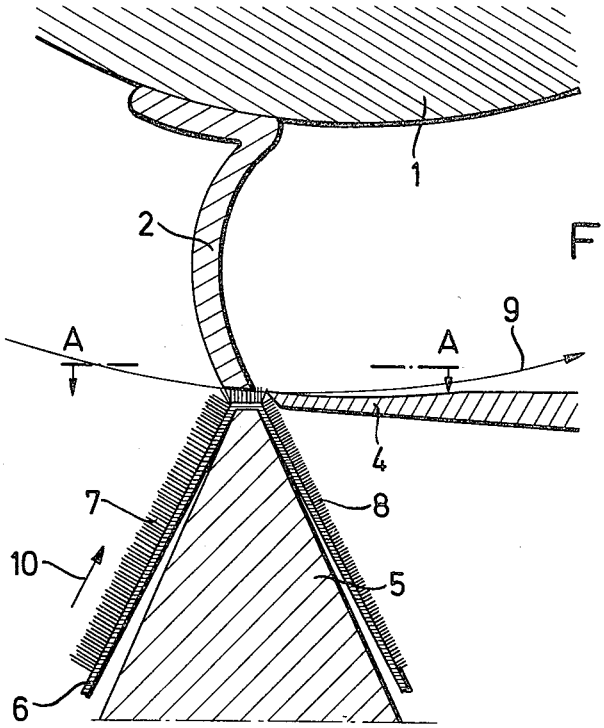
FIG. 6
FIG. 7
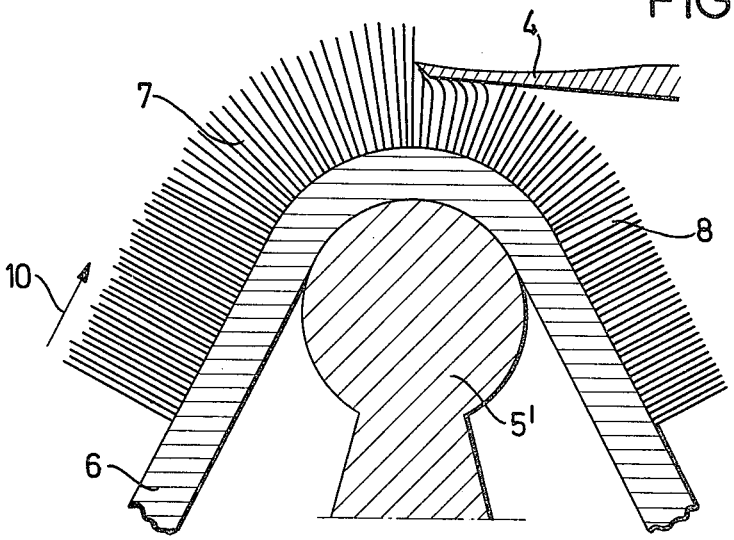

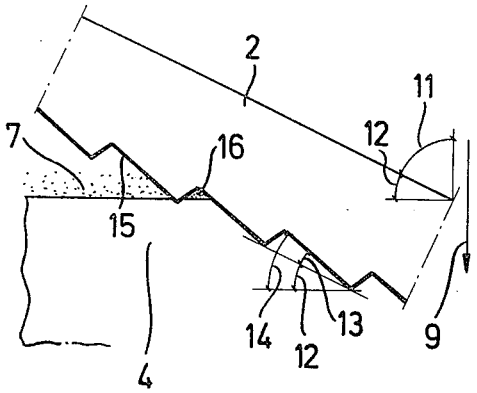
FIG. 8
PRIOR ART
FIG. 9
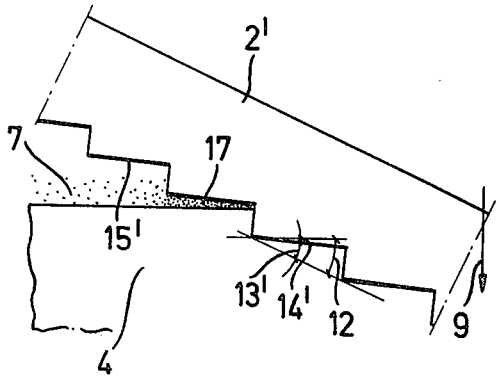
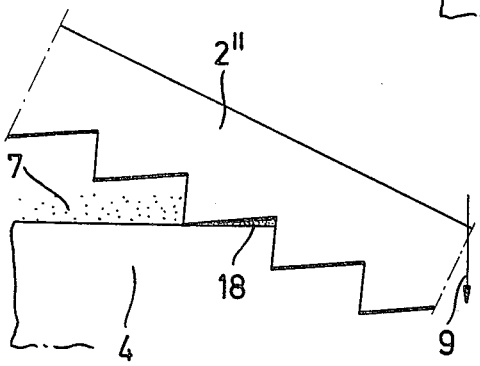
FIG. 10
FIG. 11
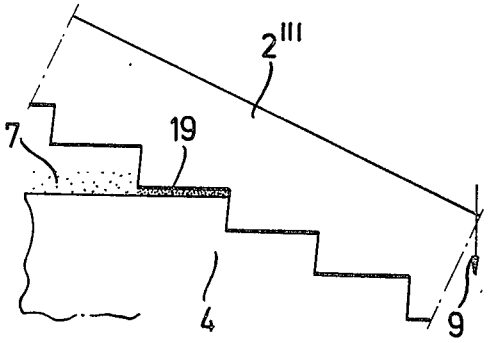

HELICAL SHEAR BLADE

The invention relates to a helical shear blade cutter which, cooperatively with the straight edge of a fixed bed plate serves to shear fibers projecting from such articles as textile fabrics, skins, furs, brushes and like materials, the cutter having a blade formed, in substance, of a helical, edgewise-wound band, with the axis of the helix extending parallel to the edge of the bed plate, the edge of the blade at the outside of the helix forming a cutting edge and the inwardly directed face adjoining the cutting edge being the cutting face of the helical shear blade.

Several of such helical shear blades are usually assembled on a common shaft and together form a multiple helix or so-called shearing cylinder. The cutting edges of the helical shear blades are inclined to the cutting edge of the bed plate at an angle hereinafter referred to as the cutting angle. This cutting angle depends upon the pitch of the helix defined by the blade.

A large cutting angle is produced when the helical pitch is short. This has the advantage that a single helix i.e. a single helical shear blade, will simultaneously cut at several locations thereof because of the very large number of turns or windings thereof about the shaft. Since the number of helical shear blades that can be mounted on a single shaft is limited, when there is a large cutting angle overall, a larger number of simultaneously cutting points are provided than if the cutting angle were small. Another advantage of a large cutting angle is that for a very large number of helical turns for an individual helical shear blade, the latter can be more readily secured reliably to the shaft than would be possible if the pitch of the helix were steep. On the other hand, a large cutting angle has the disadvantage that the fibers tend to slip sidewise during the shearing cut. This results in an irregular pile or trim which reduces the value of the product.

A small cutting angle is produced when the pitch of the helix is steep. It is an advantage of a small cutting angle that, during the shearing cut, fibers have less of a tendency to yield sidewise so that the resultant fiber pile is more uniform. On the other hand, the small cutting angle has the disadvantage that the individual helical shear blade has fewer helical turns or windings, and, therefore, fewer simultaneous cutting points are provided for the individual helical shear blade and also for the entire shearing cylinder. Moreover, a steeply pitched helix is less readily securable to a central shaft because of the more limited winding or encirclement thereof about the shaft than a helix which has more helical turns around the shaft.

A compromise solution has therefore been adopted which takes into account the advantages and disadvantages in each particular case. However, this has not been found to be satisfactory.

Thus, it has therefore been proposed heretofore to provide the cutting face of the helical shear blade with a saw-tooth or wedge-shaped serration resembling the teeth of a file in order to prevent the fibers from slipping sidewise during the shearing cut. This wedge-shaped serration is so formed that the wedge-shaped surfaces of the saw teeth define a cutting angle with respect to the edge of the bed plate, that is larger, by the angle at which the flank of the saw teeth is cut into the cutting face of the blade, than the cutting angle which the cutting edge of a blade without serrations makes with the edge of the bed plate. This prevents the fibers from completely avoiding the shearing cut since they cannot slip farther along the cutting edge than up to the next wedge-shaped corner of the serration where they are always intercepted. Due to the increase in the size of the cutting angle by the size of the angle at which the flank of the saw teeth is cut into the cutting face of the shear blade, the lateral sliding of the fibers along the cutting edge and within the limited range is increased. The fibers are therefore not evenly cut on the cutting edges of the saw-tooth serration, but rather, are bunched together in the wedge-shaped corner and then cut off in bunches or tufts. The trimmed fiber pile thereby receives undesirable patterning or texture markings. Moreover, wear along the cutting edges of the saw-tooth serration is relatively low because the fibers, on the whole, merely slide and are not cut there. On the other hand, wear in the wedge-shaped corners is excessive, because the cutting or cropping of the fibers bunched therein requires relatively high cutting forces.

A compromise solution was therefore also sought in the case of helical shear blades having cutting faces with saw-tooth serration incised therein. This compromise resulted also in this case in the use of fairly steep helices to minimize the tendency of the fibers to slide along the cutting edge on the wedge-shaped surfaces of the saw teeth into the wedge-shaped corners of the serration. Basically, the pitch of the helix, in this case, ought to have been made even steeper than for a smooth cutting face lacking a serration, in order, at least partly, to compensate for the increase in size of the cutting angle. However, this would have gone beyond the limits of sound structural design and the drawbacks that were described hereinbefore had to be taken into consideration and usually accepted as unavoidable.

It is accordingly an object of the invention of the instant application to provide a helical shear blade having a saw-tooth serration or to provide the serration per se of such construction that the fibers will not tend to avoid the cut by sliding along the cutting edge on the wedge-shaped surface of the saw teeth when the shearing cut is being made, and that the fibers will, in fact, be uniformly cut along the entire length of the respective cutting edge.

With the foregoing and other objects in view, there is provided, in accordance with the invention, a helical shear blade cutter cooperable with a straight-edge bed plate for trimming fibers projecting from an article, comprising a shaft and a blade in the form of a helical band wound edgewise on and about the shaft, the helical blade having a free edge forming a cutting edge from which a cutting face of the blade extends inwardly toward the shaft, the cutting face being formed with a serration to limit lateral yielding of the fibers as the fibers are being sheared by the cutting edge and the straight edge of the bed plate, the serration comprising saw-like teeth, respectively, having a short and a long flank, the long flank, in a condition wherein the shaft is disposed parallel to the straight-edge bed plate, forming a first angle with respect to the straight edge of the bed plate that is equal to the difference between a second angle formed by the cutting face of a blade without serrations formed therein and the straight edge of the bed plate and a third angle formed by the long flank and the cutting face of the blade without serrations found therein.

In view of the fact that the first or cutting angle of the serrated blade according to the invention is smaller than the second or cutting angle of a corresponding smooth or plain blade formed without serrations by a third angle, namely the angle the longer saw-tooth flank of the serration makes with the cutting face, the helix in a helical blade according to the invention can have a relatively short pitch and the corresponding plain edge may form a relatively large cutting or second angle; the cutting or first angle of the serrated blade can nevertheless be so small that the fibers will not slip along the wedge-shaped surfaces of the serrations, but will be cut off cleanly. The cutting edges of the blade and the bed plate wear uniformly along the entire length thereof. The helix can have relatively numerous turns or windings about the shaft and the number of cutting locations will therefore be large. The blades are affixed to the shaft securely and stably.

In addition to a secure mounting of the blades, the helical shear blade cutter of the invention assures the production of a trouble-free clean cut with a high shearing performance coupled with a long life of the blade or cutter.

In accordance with another feature of the invention, the third angle, namely the angle formed by the long flank of the serration teeth and the cutting face of the blade without serrations, is of a given size between that of an angle smaller than and an angle larger than the second angle, namely the angle formed by the cutting face of the blade without serrations and the straight edge of the bed plate, so that the absolute value of the first angle, namely the angle formed by the long flank of the serration teeth and the straight edge of the bed plate, is at most as large as the angle of friction between the fibers that are being trimmed and the cutting edge of the blade and the straight edge of the bed plate.

The angle of friction of the fibers that are to be trimmed and the cutting edges of the bed plate and helical blade is the parameter which determines whether or not the fibers, during the trimming operation, will slide along the cutting edges or remain in position so as to be cleanly cut off. If the cutting angle is at most as large as the limiting angle of friction the shear cut will be clean and there will be no yielding by lateral sliding. Although the limiting angle of friction has a different value for different fibrous materials, nevertheless, the cutting angle for satisfactory shearing can be a standard angle. It must simply not exceed the limiting angle of friction of the particular fibrous material which has the smallest limiting angle of friction. Reference is made to an absolute value or magnitude of the cutting angle, because, with the size of the cutting angle with respect to the angle of friction, it does not matter whether the cutting angle is positive or negative in relation to the straight or cutting edge of the bed plate.

In accordance with a further feature of the invention, the third angle, namely the angle of the longer flank of the saw-tooth serration substantially equals the second angle, namely the cutting angle of the corresponding plain edge of the bed plate.

With the last-mentioned feature, the resultant cutting angle i.e. the first angle, will be zero, and the cutting edges of the serration along the edge of the helical blade will form a zero angle with the edge of the bed plate. Thus, the edges of the longer flanks of the serration will be parallel to the cutting or straight edge of the bed plate. This has the advantage that even very smooth fibers which have a very small limiting angle of friction will not avoid the cut by sliding along the cutting edges but will rather be evenly cut. The first angle, namely the cutting angle of the serrated cutting edge, need not be exactly zero but may be approximate thereto. Consequently, the production of such a shear blade cutter requires no additional expense.

In accordance with an additional feature of the invention, the saw teeth of the serration are undercut. This provides the advantage that the fibers which are to be trimmed are kept away from the wedge-shaped corners of the saw-teeth and will only come into the vicinity of the cutting edges proper. Irregularities in the trimming of a pile are thereby avoided.

In accordance with yet another feature of the shear blade cutter of the invention wherein the cutter is rotatable with the shaft, the serration is formed with a cut inclined to the radial direction so that, during rotation of the cutter, the radially outer parts of the serration in the helix lead the remaining parts of the serration. Through this feature, the effect of the undercut is reinforced.

Other features which are considered as characteristic for the invention are set forth in the appended claims.

Although the invention is illustrated and described herein as embodied in a helical shear blade cutter, it is nevertheless not intended to be limited to the details shown, since various modifications and structural changes may be made therein without departing from the spirit of the invention and the scope and range of equivalents of the claims.

The construction and method of operation of the invention, however, together with additional objects and advantages thereof will be best understood from the following description of specific embodiments when read in connection with the accompanying drawings, in which:

FIG. 6 is a much-enlarged fragmentary view of FIG. 5.

FIG. 7 is a fragmentary view of FIG. 6 at the same scale as that of FIG. 6 showing a modified form of shearing table for shearing the pile of heavy textile materials, such as carpets, for example;

FIGS. 8 to 11 are horizontal part sections on an even larger scale taken on the line A — A in FIG. 6 but viewed from above, more particularly, FIG. 8 is a fragmentary view of a helical shear blade provided with a saw-tooth serration according to the state of the art; the view being even larger than that of FIG. 6 and being taken along the line A — A in FIG. 6, but rotated through 90°;

FIG. 9 is another view like that of FIG. 8 of a helical shear blade provided with a saw-tooth serration according to the invention and having a positive cutting angle between the wedge surfaces or edges of the serration and the plain or cutting edge of the bed plate;

Figure 1:
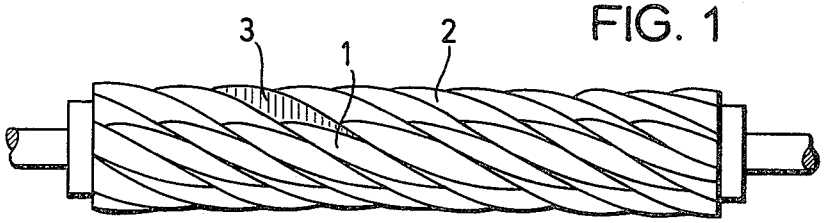
FIG. 1 is an axial view of a shearing cylinder or cutter having a plurality of helical shear blades according to the invention, which, in combination, form a multiple helix.
Figure 2:
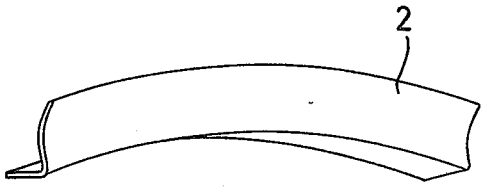
FIG. 2 is an enlarged view of a portion of a shear blade having a plain cutting face.
Figure 3:
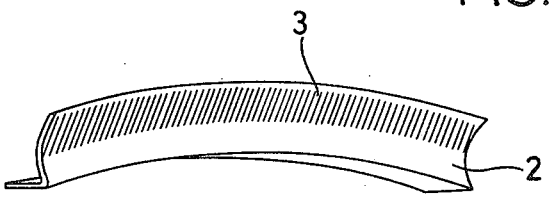
FIG. 3 is an enlarged fragmentary view of FIG. 1 showing a portion of a shear blade having a saw-tooth serration on the cutting face thereof.

FIG. 10 is a further view like those of FIGS. 8 and 9, of a helical shear blade according to the invention which is similar to that in FIG. 9, except that the cutting angle is negative; and FIG. 11 is yet another view like those of FIGS. 8, 9 and 10, of a helical shear blade according to the invention which is similar to those of FIGS. 9 and 10, except that the cutting angle is zero.

Referring now to the drawing, it is noted that FIGS. 1 to 7, in principle, also apply to conventional forms of construction of a helical shear blade cutter. These figures serve primarily to assist in providing an understanding of the problem contemplated by the invention. FIG. 8 is illustrative of the prior art, whereas FIGS. 9 to 11 show different embodiments of the invention of the instant application.

Figure 4:
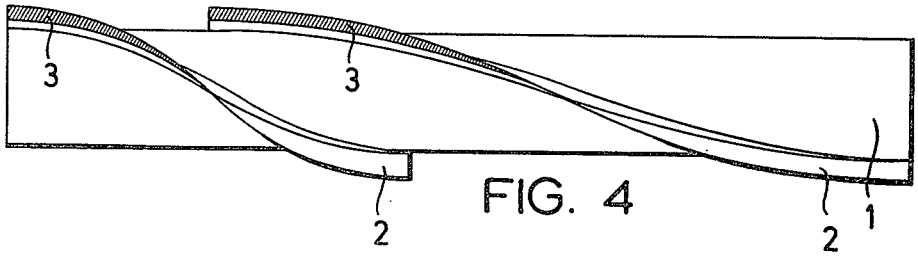
FIG. 4 is a longitudinal view, at a slightly smaller scale than that of FIGS. 2 and 3, of two serrated helical shear blades of which the balde at the left-hand side of the figure is less steeply pitched than the blade at the right-hand side.

As shown in FIG. 1, helical shear blades 2 are secured to a shaft 1 of a shearing cylinder or cutter. In general, the blades 2 are formed with serrations 3. For a clearer representation thereof, reference may be made to FIG. 3 which is distinguished from the construction of FIG. 2 wherein the helical blade 2 does not have a serration. As shown in FIG. 4, the helix defined by the cutter blades may have a short pitch (left-hand side) or a long pitch (right-hand side). When the pitch is short, the cutting angle formed by the cutter blade with the straight edge of the bed plate will be relatively larger, whereas it will be relatively smaller when the pitch is long.

Figure 5:
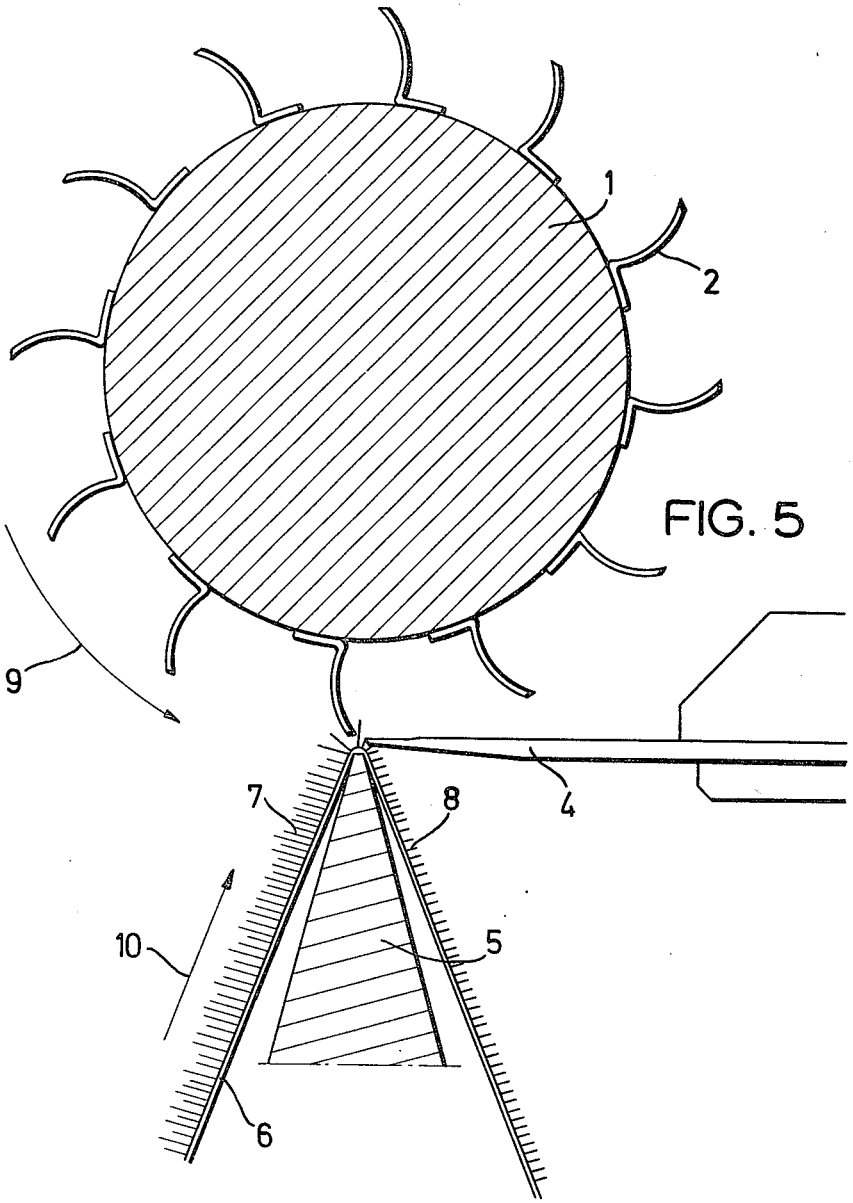
FIG. 5 is a diagrammatic cross-sectional view, at a slightly larger scale than that of FIGS. 2 and 3, of a complete shearing cylinder or cutter, together with a bed plate, a shearing table and a material to be trimmed that is being drawn across the shearing table.

As shown in FIG. 5, the shearing cylinder or cutter with the shaft 1 and the helical shear blades 2 thereof revolves in direction of an arrow 9 over a stationary bed plate 4. Material 6 which is to be cropped or trimmed travels over a shearing table 5, in a direction represented by an arrow 10. Prior to being sheared, the material 6 has projecting relatively long, irregular fibers 7 and, after shearing, cropped relatively short, uniform fibers 8. In this regard, reference is also made to FIGS. 6 and 7. In FIG. 7, a shearing table 5′ of special configuration is shown.

FIG. 8 illustrates helical shear blade 2 according to the prior art, and a fixed bed plate 4. As shown in FIG. 8, a non-serrated or plain helical blade has an angular pitch 11 and a cutting angle 12. The helical blade 2 travels in a direction as indicated by the arrow 9 relative to the fixed bed plate 4. The longer tooth flank 15 of the serration forms an angle 13 with the cutting face of a blade having no serrations, the angle 13 together with the cutting angle 12 of a plain or non-serrated blade, equaling the cutting angle 14 of the serrated blade. Owing to the magnitude of angle 14, the fibers 7 which are to be trimmed slide along the edges 15 of the serrations without being cut. They are thus forced into corners 16 where they are cut off in tufts or bunches. Undesirable patterned or structure markings are consequently imparted to the fiber pile.

Referring now to FIG. 9, there is illustrated therein an embodiment of a helical cutter 21 according to the present invention, shown cooperating with a fixed bed plate 4. The blade 2′ travels across the bed plate 4 in direction indicated by the arrow 9. The cutting angle 12 of a plain or non-serrated shear blade is shown again in FIG. 9. The cutting angle 14′ of the serrated blade equals the difference between the cutting angle 12 of a corresponding non-serrated blade and the angle 13′ of the lower tooth flanks of the serration. The angle 14′ can be so small that it is less than the limiting angle of friction of the fibers 7 with respect to the cutting edges 15′ of the helical shear blade 2′ and the cooperating cutting or plain edges of the bed plate 4. The fibers 7 in the space 17 will not therefore slide away towards one side but will instead be cut off cleanly.

In the embodiment of the blade 2″ according to the invention, as shown in FIG. 10, the angle 13 of the longer tooth flanks of the serrations exceeds the cutting angle 12 of the plain or non-serrated helical blade, and the cutting angle 14 of the serrated blade is therefore a negative angle. In the space 18 which forms at each cut, the fibers 7 are also unable to yield or slide laterally but are rather cleanly cropped or trimmed.

In the embodiment 2‴ of the invention shown in FIG. 11, the angle 13 of the longer tooth flanks is equal to the cutting angle 12 of the corresponding plain or non-serrated cutter blade. The cutting angle 14 of the serrated cutter blade is therefore zero. The fibers in the space 19 are therefore cut off cleanly without slipping sideways.

As is readily apparent from FIGS. 8 to 11, the saw-tooth serration of the embodiments of the invention shown in FIGS. 9 to 11 have a mirror-image symmetry with that of the heretofore known helical serrated shear blade shown in FIG. 8.

It is claimed:

1. Helical shear blade cutter cooperable with a straight-edge bed plate for trimming fibers projecting from an article, comprising a shaft, and a blade in the form of a helical band wound edgewise on and about said shaft, said helical blade having a free edge forming a cutting edge from which a cutting face of said blade extends inwardly toward said shaft, said cutting face being formed with a serration to limit lateral yielding of the fibers as the fibers are being sheared by said cutting edge and the straight edge of the bed plate, said serration comprising saw-like teeth, respectively, having a short and a long flank, said long flank, in a condition wherein said shaft is disposed parallel to the straight-edge bed plate, forming a first angle with respect to the straight edge of the bed plate that is equal to the difference between a second angle formed by the cutting face of a blade without serrations formed therein and the straight edge of the bed plate and a third angle formed by said long flank and the cutting face of the blade without serrations formed therein.

2. Helical shear blade cutter according to claim 1 wherein said third angle is of a given size between that of an angle smaller than and an angle larger than said second angle so that the absolute value of said first angle is at most as large as the angle of friction between the fibers that are being trimmed and said cutting edge of said blade and the straight edge of the bed plate.

3. Helical shear blade cutter according to claim 1 wherein said third angle is substantially as large as said second angle.

4. Helical shear blade cutter according to claim 1 wherein the saw teeth of said serration are formed by respective undercuts in said cutting face.

5. Helical shear blade cutter according to claim 1 wherein the cutter is rotatable about said shaft thereof, said serration being formed with a cut inclined to the radial direction so that, during rotation of the cutter, the radially outer parts of said serration in the helix lead the remaining parts of said serration.

* * * * *

UNITED STATES PATENT AND TRADEMARK OFFICE

CERTIFICATE OF CORRECTION

PATENT NO. : 3,931,750

DATED : January 13, 1976

INVENTOR(S) : HARTMUT JABS

It is certified that error appears in the above-identified patent and that said Letters Patent are hereby corrected as shown below:

In the heading to the printed specification, after line 9, insert --and MINNY WIEMERS residing in Dusseldorf-Gerresheim, Germany doing business as the Limited Partnership of SEVRIN HEUSCH, in Aachen, Germany--

Signed and Sealed this

Thirteenth Day of July 1976

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,931,750

DATED : January 13, 1976

INVENTOR(S) : HARTMUT JABS

It is certified that error appears in the above-identified patent and that said Letters Patent are hereby corrected as shown below:

In the heading to the printed specification, lines 2, 3, 4 and 5 (item 75) should be deleted and replaced by --Inventor: Hartmut Jabs, Verlautenheide, Germany--

Signed and Sealed this

Thirty-first Day of August 1976

[SEAL]

*Attest:*

RUTH C. MASON
*Attesting Officer*

C. MARSHALL DANN
*Commissioner of Patents and Trademarks*